US009302812B2

(12) United States Patent
Rees et al.

(10) Patent No.: US 9,302,812 B2
(45) Date of Patent: Apr. 5, 2016

(54) CONTAINER PANEL IMPROVEMENTS

(75) Inventors: Michael Rees, Camden Park (AU); Ian Sharkey, Camden Park (AU); Matthew Reimers, Camden Park (AU)

(73) Assignee: REES OPERATIONS PTY LTD, Camden Park (AU)

( * ) Notice: Subject to any disclaimer, the term of this patent is extended or adjusted under 35 U.S.C. 154(b) by 0 days.

(21) Appl. No.: 13/992,445

(22) PCT Filed: Dec. 8, 2011

(86) PCT No.: PCT/AU2011/001592

§ 371 (c)(1), (2), (4) Date: Aug. 21, 2013

(87) PCT Pub. No.: WO2012/075537

PCT Pub. Date: Jun. 14, 2012

(65) Prior Publication Data

US 2014/0319131 A1 Oct. 30, 2014

(30) Foreign Application Priority Data

Dec. 8, 2010 (AU) ..... 2010905404
Aug. 17, 2011 (AU) ..... 2011903280

(51) Int. Cl.
*B65D 21/08* (2006.01)
*B65D 6/00* (2006.01)
*B65D 6/24* (2006.01)

(52) U.S. Cl.
CPC ..... *B65D 21/086* (2013.01); *B65D 11/1873* (2013.01)

(58) Field of Classification Search
CPC ..... B65D 21/086; B65D 11/1873
USPC ..... 220/668, 639, 6, 9.4, 9.2, 9.1, 666, 657, 220/23.83, 23.86, 23.87, 23.88, 23.89, 220/62.11, 62.12, 62.13, 62.14, 62.15
See application file for complete search history.

(56) References Cited

U.S. PATENT DOCUMENTS 4,558,797 A * 12/1985 Mitchell ..... 220/668
4,993,574 A * 2/1991 King et al. ..... 220/1.5
(Continued)

FOREIGN PATENT DOCUMENTS

AU 199667989 B2 4/1997
GB 1065942 A 4/1967
WO WO 2004/014748 A1 2/2004

OTHER PUBLICATIONS

International Search Report prepared by the Australian Patent Office on Feb. 21, 2012, for International Application No. PCT/AU2011/001592.

*Primary Examiner* — Robert J Hicks
*Assistant Examiner* — Kareen Thomas
(74) *Attorney, Agent, or Firm* — Sheridan Ross P.C.

(57) ABSTRACT

This invention relates to a gate or panel for a storage container comprising a rectangular or square infill panel having an inner face and an outer face, an outer perimeter frame adjacent to the outer face of the infill panel, and an infill panel attachment member attached to and extending along at least a pair of opposing margins of the gate, each infill panel attachment member comprising an infill panel retaining flange which extends in a plane parallel to an inner face of the perimeter frame so that the infill panel is retained between the retaining flanges and an inner face of the outer perimeter frame.

13 Claims, 4 Drawing Sheets

(56) References Cited

U.S. PATENT DOCUMENTS 6,109,052 A * 8/2000 Austin, Jr. ..... 62/259.1
6,161,714 A * 12/2000 Matsuura ..... B62D 29/045 220/1.5
6,467,640 B1 * 10/2002 Hung ..... E05D 7/1011 174/50
6,796,452 B2 * 9/2004 Petzitillo et al. ..... 220/378
8,100,280 B1 * 1/2012 Hernandez ..... 220/9.4
2007/0051720 A1 3/2007 Chen

* cited by examiner

CONTAINER PANEL IMPROVEMENTS

CROSS REFERENCE TO RELATED APPLICATIONS

This application is a national stage application under 35 U.S.C. 371 and claims the benefit of PCT Application No. PCT/AU2011/001592 having an international filing date of 8 Dec. 2011, which designated the United States, and which PCT application claimed the benefit of Australian Patent Application No. 2010905404 filed 8 Dec. 2010 and Australian Patent Application No. 2011903280 filed 17 Aug. 2011, the disclosure of which is incorporated herein by reference.

PRIORITY

This patent application claims priority from:

Australian Provisional Patent Application No 2010905404, titled "CONTAINER PANEL IMPROVEMENTS", and filed on 8 Dec. 2010; and Australian Provisional Patent Application No 2011903280, titled "CONTAINER PANEL IMPROVEMENTS", and filed on 17 Aug. 2011.

The entire content of these applications is hereby incorporated by reference.

BACKGROUND

Collapsible containers having side and end panels or gates which are attached to the container base so as to be movable between upright erected positions and collapsed positions wherein they lie in a flat condition on top of the base, are known in the materials handling industry. Many different types of connections between the panels/gates and the base have been utilised, including both permanent pivotal attachments therebetween, as well as detachable connections which allow the panels/gates to be physically separated from the base if required.

When the panels/gates are erect, generally the opposite vertical perimeter frame members on one panel respectively abut against inner faces of adjacent panels, with adjacent panels being interlocked by means of manually releasable locking or latching mechanisms which are normally located at the top corners of the panels and which, when in their locking conditions, securely lock the adjacent panels together in their upright positions.

An example of a container of the above described type is disclosed in the U.S. Pat. No. 7,784,631. Such containers can be adapted for the storage and transport of products including fresh and frozen meat, grains, powders and cereals, by the installation of a food grade plastic liner panel inside all side frames, as well as the lid thereof.

These plastic liners are typically fixed to the frames using fasteners, such as screws, which are driven through the liner and into the frame from an inner face of the liner.

A potentially serious problem arises however, where one of these screws works loose and falls into the contents of the container.

It is an object of the invention therefore to substantially ameliorate one or more of the above stated difficulties, or at least provide useful alternatives to known containers and container panels and gates.

Other objects and advantages of the present invention will become apparent from the following description, taken in connection with the accompanying drawings, wherein, by way of illustration and example, an embodiment of the present invention is disclosed.

SUMMARY OF THE INVENTION

In one aspect, the invention the may be said to reside in a gate or panel for a storage container comprising a rectangular or square infill panel having an inner face and an outer face, an outer perimeter frame adjacent to the outer face of the infill panel, and an infill panel attachment member attached to and extending along at least a pair of opposing margins of the gate, each infill panel attachment member comprising an infill panel retaining flange which extends in a plane parallel to an inner face of the perimeter frame so that the infill panel is retained between the retaining flanges and an inner face of the outer perimeter frame.

In one form, the infill panel is clamped between the retaining flanges and the inner face of the outer perimeter frame.

In one form, the opposing margins are vertical margins of the gate or panel.

In one form, the opposing margins are horizontal margins of the gate or panel.

In one form, wherein the infill panel attachment members extend along both opposing vertical and horizontal margins of the gate or panel.

In one form, each elongate infill panel attachment member is an elongate member of constant cross-sectional shape terminating at one end in the infill panel retaining flange, and at its other end in an intra-panel attachment flange secured to a margin of its associated perimeter frame.

In one form, each elongate infill panel attachment member is an elongate member of constant cross-sectional shape terminating at one end in the infill panel retaining flange, and at its other end in an inter-gate or panel attachment flange, which is attachable to another erected gate or panel of the container.

In one form, the infill panel retaining flange extends from an intra-panel attachment portion secured to the vertical margin of its associated perimeter frame.

In one form, the infill panel is a solid plastic infill panel.

In one form, the infill panel is a solid sheet of food grade plastic.

In one form, the gate or panel comprises locking means arranged to releasably lock adjacently erected gates or panels together.

In one form, the locking means is a manually releasable locking or latching mechanism.

In one form, the gate or panel further comprises means for attaching the gate or panel to a container base.

In one form, the attachment means creates a permanent attachment.

In one form, the attachment means creates a pivotable attachment.

In one form, the attachment means creates a detachable attachment.

In one form, the gate or panel further comprises a plurality of hingedly connected sections.

In a further aspect, the invention the may be said to reside in a gate or panel for a storage container comprising a rectangular or square infill panel having an inner face and an outer face, an outer perimeter frame adjacent to the outer face of the infill panel, and an infill panel attachment member attached to and extending along a margin of the gate, the or each infill panel attachment member comprising an infill panel retaining flange which extends in a plane parallel to an inner face of the perimeter frame so that the infill panel is retained between the retaining flange or flanges and an inner face of the outer perimeter frame.

In a further aspect, the invention the may be said to reside in a storage container comprising a base, two pairs of opposing side and end gates or panels, each gate or panel comprising a rectangular or square infill panel having an inner face and an outer face, an outer perimeter frame adjacent to the outer face of the infill panel, and an infill panel attachment member attached to and extending along at least a pair of opposing margins of each of the gates or panels, each infill panel attachment member comprising an infill panel retaining flange which lies in a plane parallel to an inner face of the perimeter frame so that the infill panel is retained between the retaining flange and the inner face of the outer perimeter frame.

BRIEF DESCRIPTION OF THE DRAWINGS

For a better understanding of this disclosure it will now be described with respect to an exemplary embodiment which shall be described herein with the assistance of drawings wherein.

DETAILED DESCRIPTION OF AN EMBODIMENT OF THE INVENTION

Figure 1:
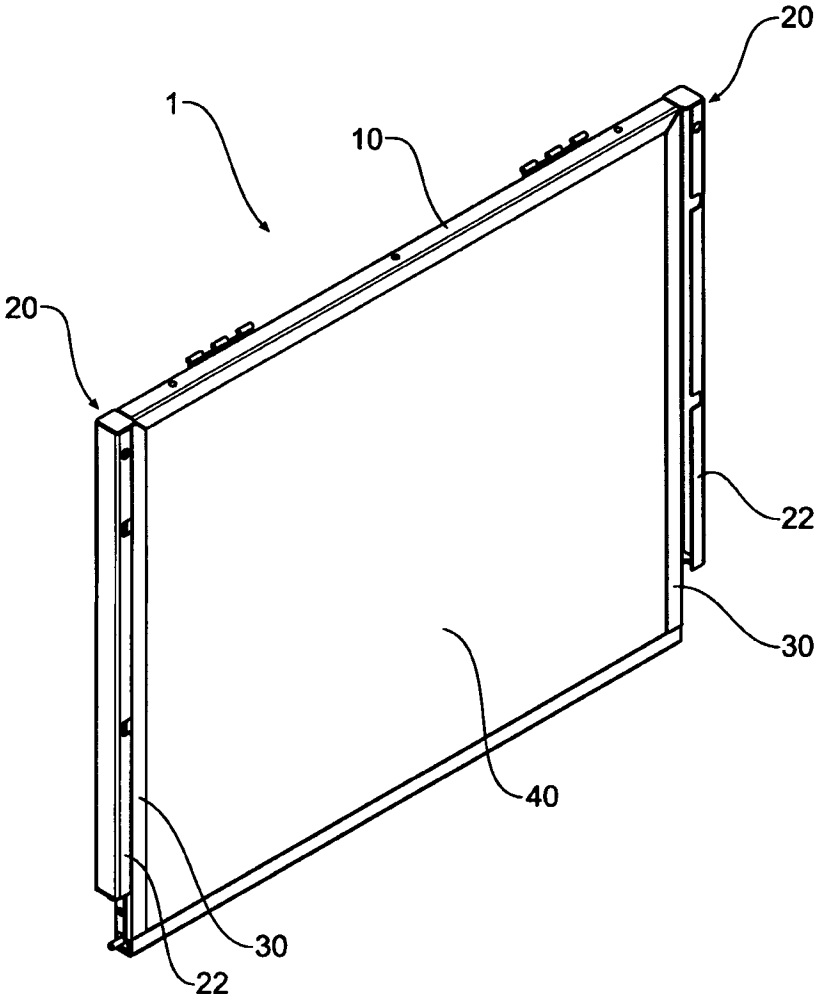
FIG. 1 is a perspective view of a gate for a collapsible container, when viewed from its inner side.
Figure 3:
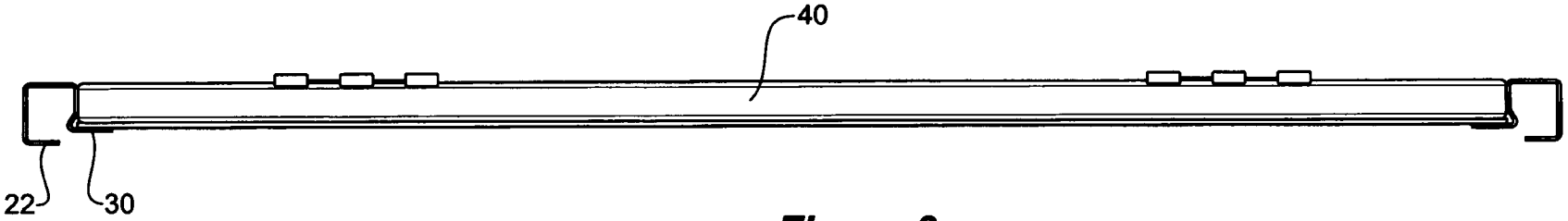
FIG. 3 is a top view of the gate in FIGS. 1 and 2.

Referring now to FIG. 1, where there is illustrated a gate 1 for a collapsible container of the kind which includes a rectangular pallet base which is provided at each of its four corners with stub corner posts, the base having a horizontal removable floor panel supported by a plurality of floor support members and additional intermediate bearers.

In this embodiment, the container is provided with a first pair of folding side gates and a second pair of opposing folding end gates, each panel being pivotally mounted via hinges adjacent its bottom corners to form a gate 1 which can be swung inwardly from its erect in-use position to a collapsed position on top of the pallet base. These erected gates 1 interlock with one another along their adjacent vertical margins, which enhances the stiffness and rigidity of the erected container.

It should be understood that while a hinged gate 1 is discussed here, the invention is equally applicable to a panel that is detachable from the base so that the panel may be laid down, and a panel that is permanently fixed in an erected position.

The gate 1 comprises an outer perimeter metal frame 10 of tubular or angle section frame members. An infill (or liner) panel attachment member 20 (see FIG. 5) comprises a laterally inwards directed infill panel retaining flange 30, and is attached to each of the opposing vertical margins of the outer perimeter frame 10.

Figure 4:
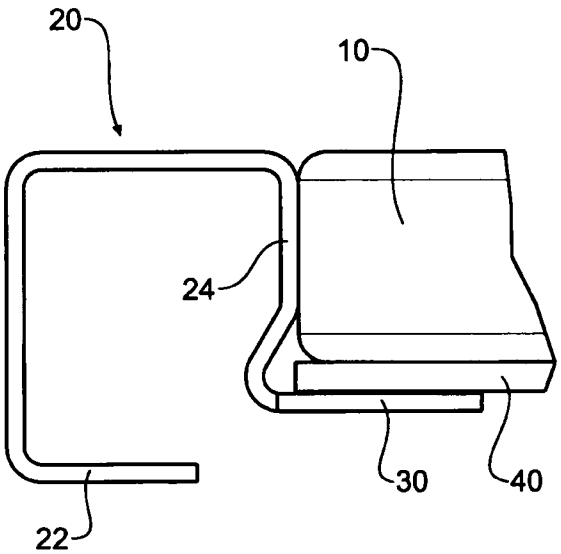
FIG. 4 is a detailed top view of an end of the gate illustrated in FIGS. 1 through 3.

As is best illustrated in FIG. 4, the infill panel retaining flange 30 extends behind and lies in a plane parallel to an inner face of the perimeter frame 10 so that an infill panel (or liner) 40 of, in this embodiment, food grade plastic sheet is securely retained between the retaining flange 30 and the inner face of the perimeter frame 10 without need for fasteners. It will be apparent however that infill panels of practically any material may be retained by the infill panel retaining flanges 30.

Figure 5:
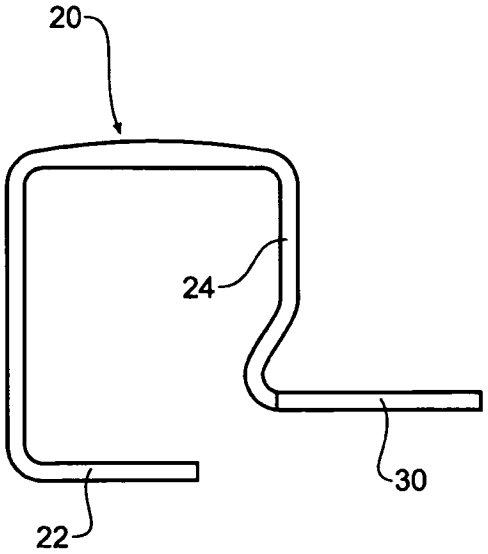
FIG. 5 is a top view of an infill panel attachment member from the gate illustrated in FIGS. 1 through 4.

As is best illustrated in FIG. 5, the infill panel attachment member 20 is an approximate C-section shaped, elongate, steel channel which terminates at one end in the infill panel retaining flange 30, and at its other end in an inter-gate attachment flange 22, which is attachable to another gate 1 of the container in its erected position.

The infill panel retaining flange 30 extends from an intra-gate attachment portion 24 which is secured to the vertical margin of the perimeter frame 10 by welding.

Figure 2:
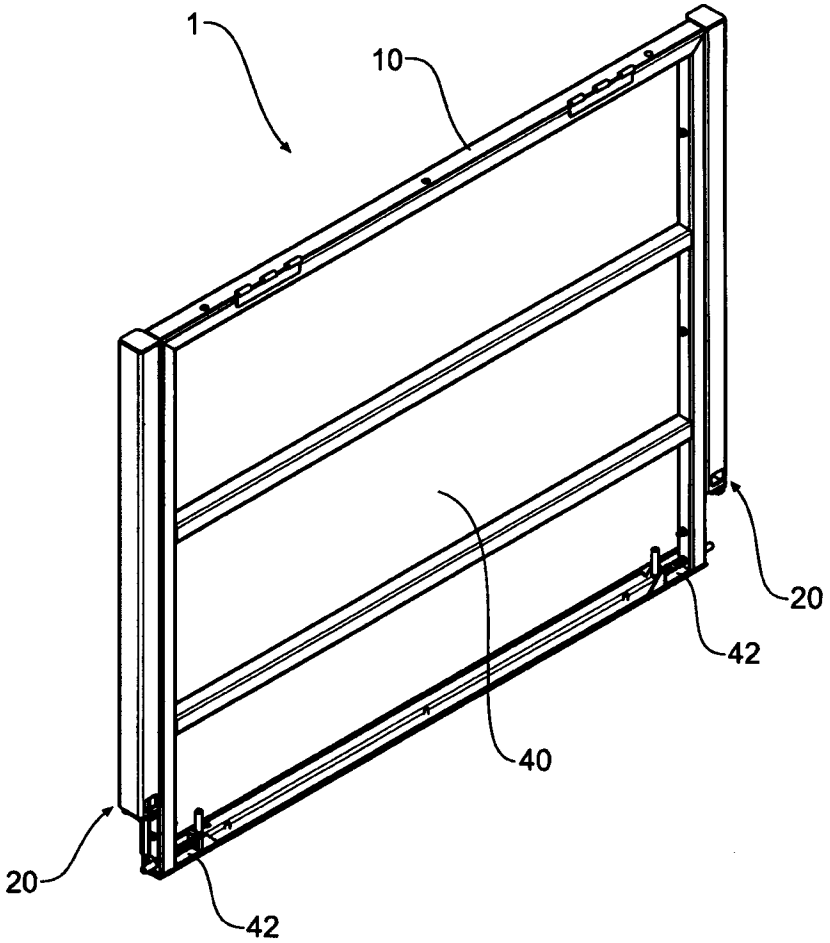
FIG. 2 is a perspective view of the gate in FIG. 1, when viewed from its outer side.

As is best illustrated in FIG. 2, retractable latch bolts 42 are slidably mounted in corner regions of the gate 1. Each latch bolt 42 is arranged to pass through aligned holes formed in the infill panel attachment member 20 of one vertical margin and into an aperture in either of the inter-gate attachment flange 22 of an infill panel attachment member 20 of another gate 1, thereby securing these two gates 1 relative to each other in the erected position, or the stub corner posts.

Figure 6:
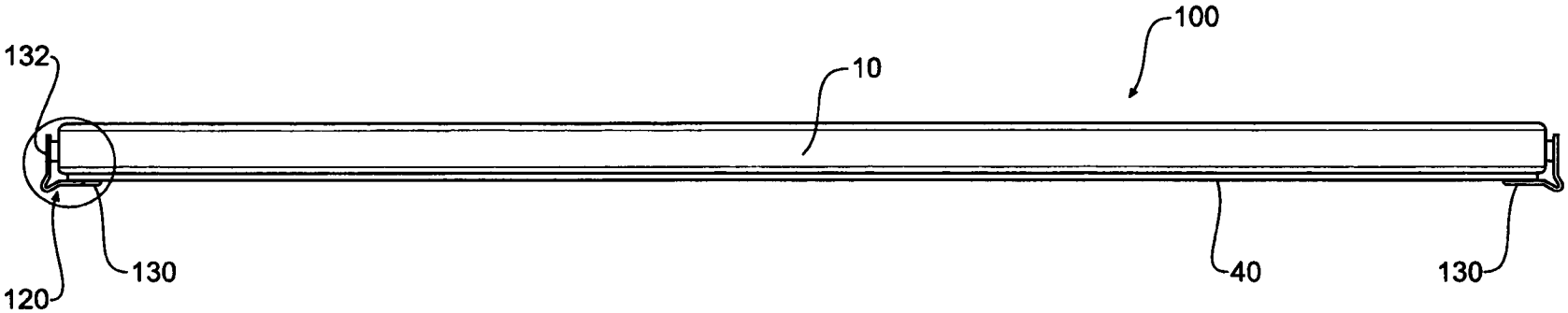
FIG. 6 is a top view of a gate according to a further embodiment of the invention.
Figure 8:
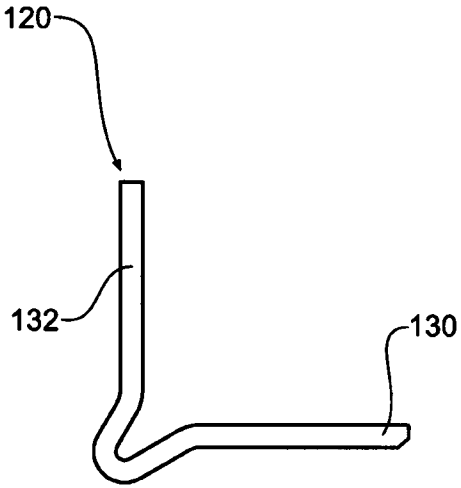
FIG. 8 is a top view of an infill panel attachment member from the gate illustrated in FIGS. 6 and 7.
Figure 7:
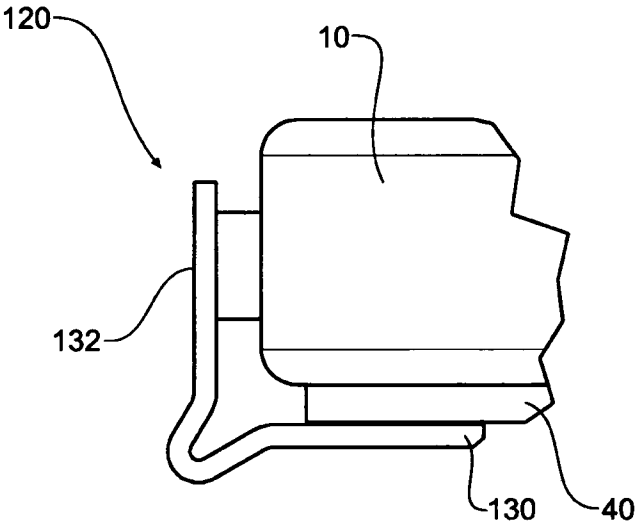
FIG. 7 is a detailed top view of an end of the gate illustrated in FIG. 6.

Referring now to FIGS. 6 through 8, where there is illustrated a gate 100 comprising an outer perimeter metal frame 10 of tubular or angle section frame members as before. An infill (or liner) panel attachment member 120 (see FIG. 8) comprising an infill panel retaining flange 130 is attached to opposing margins of the outer perimeter frame 10.

As is best illustrated in FIGS. 7 and 8, the infill panel attachment member 120 is a generally L-shaped steel channel which terminates at one end in the infill panel retaining flange 130, and at its other end in an intra-panel attachment flange 132, which is secured by welding in this case to a margin of the outer perimeter frame 10.

Figure 9:
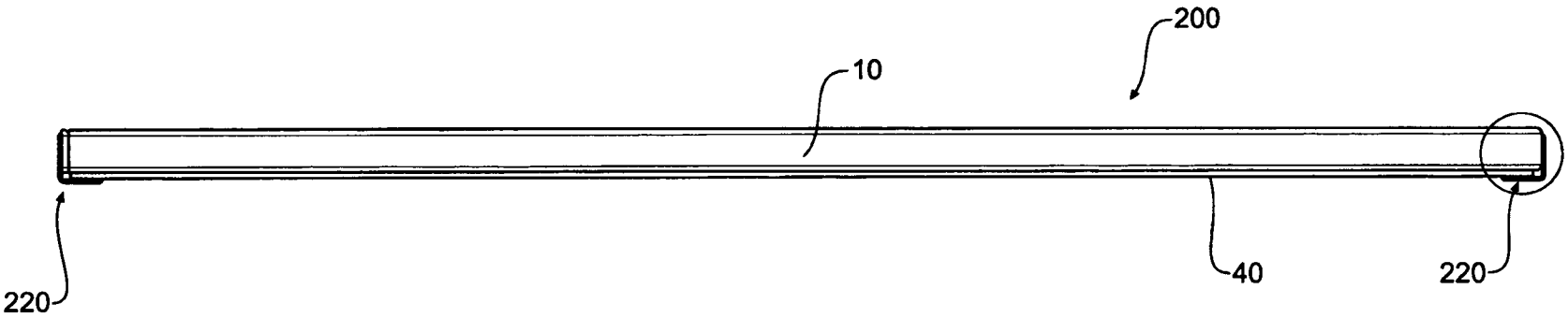
FIG. 9 is a top view of a gate according to a further embodiment of the invention.
Figure 11:
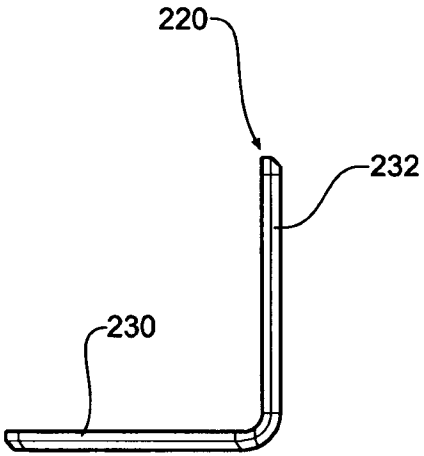
FIG. 11 is top view of an infill panel attachment member from the gate illustrated in FIGS. 9 and 10.
Figure 10:
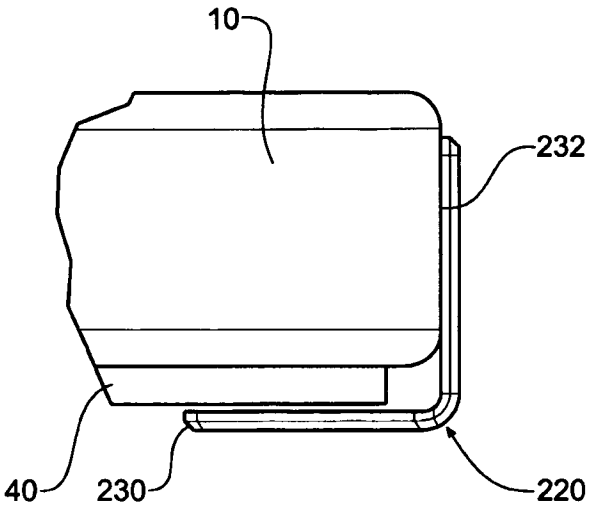
FIG. 10 is a detailed top view of an end of the gate illustrated in FIG. 9.

Referring now to FIGS. 9 through 11, where there is illustrated a gate 200 comprising an outer perimeter metal frame 10 of tubular or angle section frame members as before. An infill (or liner) panel attachment member 220 (see FIG. 11) comprising an infill panel retaining flange 230 is attached to opposing margins of the outer perimeter frame 10.

As is best illustrated in FIGS. 10 and 11, the infill panel attachment member 220 is a generally L-shaped steel angle section which terminates at one end in the infill panel retaining flange 230, and at its other end in an intra-panel attachment flange 232 which is secured by welding to opposing margins of the outer perimeter frame 10.

It will be apparent that combinations of infill (or liner) panel attachment members 20, 120 and 220 can be employed on a gate or panel, and that one or more of these may be secured to the frame 10 by releasable means, so as to permit access to the infill panel 40 when required.

It will be appreciated that the design of the gates eliminates the need for screws to retain the infill or liner panel 40. Moreover, the modular design construction of the panels provides increased design flexibility. The same panel module can be used for both the side and end gates of the container. Also gates can be readily interchanged, eg by for example so as to convert a one-piece end gate into a bi-fold gate which is divided horizontally into two halves hinged together to permit the two halves to hinge relative to one another, or modified so as to include a hopper in its top or bottom half. In addition the infill panels of the gates can be readily changed, for example from the one-piece solid plastics panel to a metal mesh infill panel, without the need to remove and reapply numerous fasteners.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

The invention claimed is:

1. A gate or panel for a storage container comprising a rectangular or square infill panel having an inner face and an outer face, an outer perimeter frame adjacent to the outer face of the infill panel, an infill panel attachment member attached to and extending along at least a pair of opposing margins of the outer perimeter frame and an attachment means for attaching the gate or panel to a container base, each infill panel attachment member comprising an infill panel retaining flange enabling the infill panel to be retained between the retaining flanges and an inner face of the outer perimeter frame;

wherein each infill panel attachment member terminates at one end in the infill panel retaining flange, and at its other end in an intra-panel attachment flange secured to a margin of the outer perimeter frame; and wherein the attachment means creates a pivotable attachment.

2. The gate or panel of claim 1, wherein the infill panel is clamped between the retaining flanges and the inner face of the outer perimeter frame.

3. The gate or panel as in claim 1, wherein the opposing margins are vertical margins of the gate or panel.

4. The gate or panel as in claim 1, wherein the opposing margins are horizontal margins of the gate or panel.

5. The gate or panel as in claim 1, wherein the infill panel attachment members extend along both opposing vertical and horizontal margins of the gate or panel.

6. The gate or panel as in claim 1, wherein each infill panel attachment member is an elongate member of constant cross-sectional shape.

7. The gate or panel as in claim 1, wherein the infill panel is a solid plastic infill panel.

8. The gate or panel as in claim 1, further comprising locking means arranged to releasably lock adjacently erected gates or panels together.

9. The gate or panel of claim 8, wherein the locking means is a manually releasable locking or latching mechanism.

10. The gate or panel of claim 1, wherein the attachment means creates a permanent attachment.

11. The gate or panel of claim 1, wherein the attachment means creates a detachable attachment.

12. The gate or panel as in claim 1, further comprising a plurality of hingedly connected sections.

13. The gate or panel as in claim 1, wherein the infill panel retaining flange extends in a plane parallel to an inner face of the perimeter frame.

* * * * *